United States Patent [19]

Herbst et al.

[11] Patent Number: 4,971,493

[45] Date of Patent: Nov. 20, 1990

[54] ANCHORING DEVICE FOR THE ROD-SHAPED TENSION MEMBER OF AN ANCHOR, ESPECIALLY A ROCK MEMBER

[75] Inventors: Thomas Herbst, Wessling; Lorenz Schnitzler, Pöcking, both of Fed. Rep. of Germany

[73] Assignee: Dyckerhoff & Widmann Aktiengesellschaft, Munich, Fed. Rep. of Germany

[21] Appl. No.: 419,196

[22] Filed: Oct. 10, 1989

[30] Foreign Application Priority Data

Oct. 8, 1988 [DE] Fed. Rep. of Germany ..... 8812655

[51] Int. Cl.[5] ..... E21D 21/02

[52] U.S. Cl. ..... 411/5; 405/259; 411/9

[58] Field of Search ..... 405/259, 260, 261, 262, 405/288; 411/2, 3, 5, 8, 9, 10, 14

[56] References Cited

U.S. PATENT DOCUMENTS

| | | | |
|---|---|---|---|
| 3,534,651 | 10/1970 | Belfiglio | 411/9 |
| 3,728,933 | 4/1973 | Grube | 411/5 |
| 3,908,508 | 9/1975 | Payne | 411/14 |
| 4,378,180 | 3/1983 | Scott | 405/259 |
| 4,408,936 | 10/1983 | Williamson | 411/3 |
| 4,410,296 | 10/1983 | Unrug | 405/259 |
| 4,627,774 | 12/1986 | Bradley | 411/5 |

FOREIGN PATENT DOCUMENTS 1005474 4/1957 Fed. Rep. of Germany .

*Primary Examiner*—David H. Corbin
*Attorney, Agent, or Firm*—Toren, McGeady & Associates

[57] ABSTRACT

An anchoring device for a tension member of an earth- or rock anchor, where a support element transmitting the tensile force is arranged between an anchoring element undisplaceably connected with the tension member and an anchor plate abuttable against a support base, the support element includes a cylindrical hollow body surrounding the anchoring element, whose inner wall has in its lower region projections protruding inward beyond its inner contour, against which the anchoring element abuts in a force-transmitting manner with partial regions of its cross-sectional area. If a predetermined tensile force is exceeded, the support element and/or the anchoring element can plastically deform in the region of their inter-engaging surfaces, so that a relative displacement occurs in axial direction. Distance or spacer pins are provided in a head plate placed upon the tension member for visual indication of the relative displacement, which after contact with the surface of the hollow body exit upwards from the head plate.

15 Claims, 3 Drawing Sheets

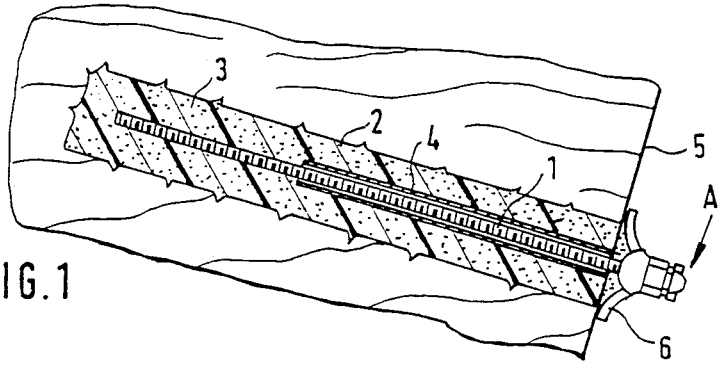
FIG. 1
FIG. 6
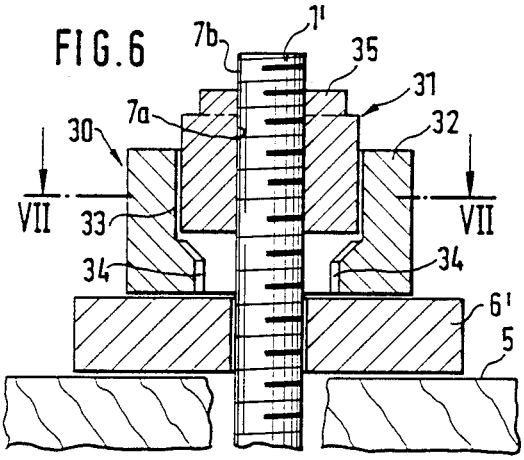
FIG. 7
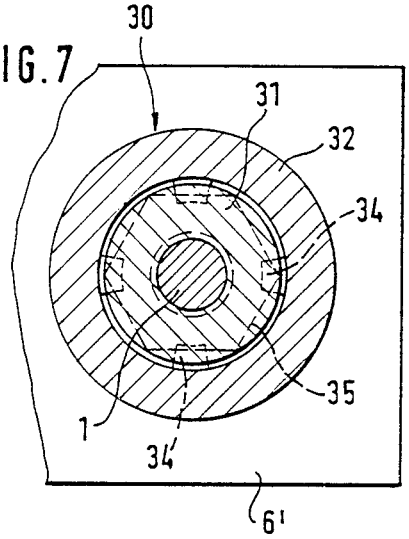
FIG. 8
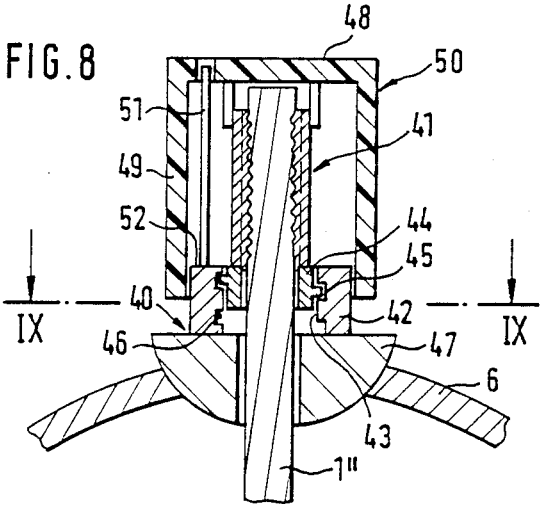
FIG. 9
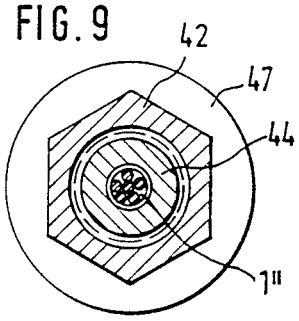

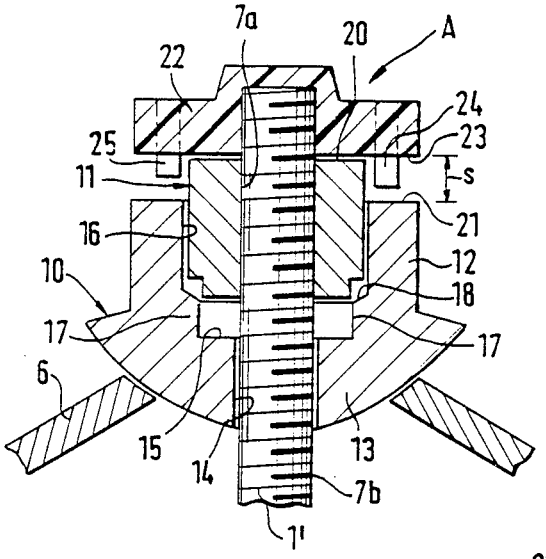
FIG. 2a
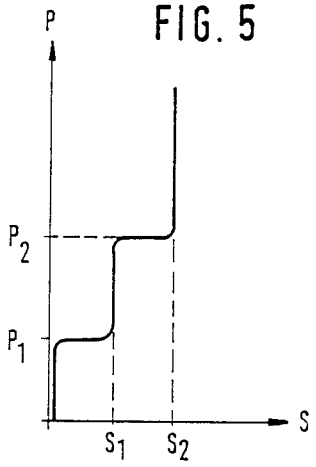
FIG. 5
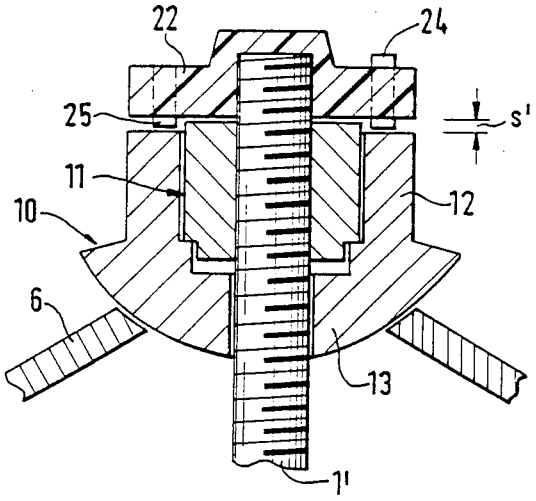
FIG. 2b
FIG. 3
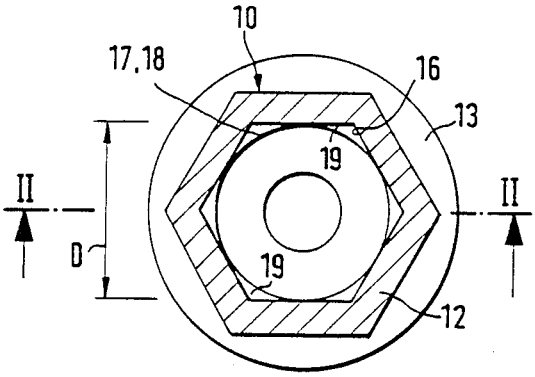
FIG. 4
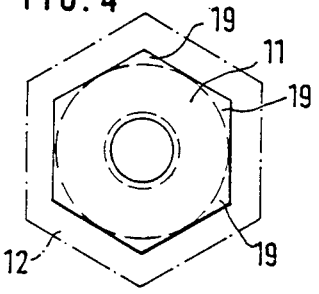

ANCHORING DEVICE FOR THE ROD-SHAPED TENSION MEMBER OF AN ANCHOR, ESPECIALLY A ROCK MEMBER

BACKGROUND OF THE INVENTION

The invention is directed to an anchoring device for a tension member, especially the tension member of an earth or rock anchor, where a support element transmitting the tensile stress is arranged in between an anchoring member undisplaceably connected with the tension member and an anchor plate supported by an abutment and where a relative displacement between the anchoring member and the support element in the direction of the tensile force is effective for the purpose of indicating that a predetermined tensile force has been exceeded.

When driving subterranean excavations, rock anchors together with pneumatically applied or gunned concrete and arc-shaped reinforcements are becoming more and more standard construction, at least for the outer shell-shaped securing of the strata next to the cavity wall. However, this type of construction which has become known under the term "New Austrian Tunnel Construction Type" also requires a careful dimensional monitoring of this securing of the rock strata or ground. Devices suitable for this process are mostly based on a control of the anchoring force applied to the anchor, and are very expensive. An exact monitoring can therefore only be accomplished in selected dimensional cross-sections of a tunnel. In spite of that, monitoring in between these dimensional cross-sections would also be desirable for reasons of safety.

It has therefore become known to equip anchoring devices of this type with arrangements for an optical or acoustical display or indication if a predetermined anchoring force is exceeded. Thus in a known rock anchor, with an anchor rod as a tension member, a spring element having a load-carrying capacity corresponding to the respectively desired prestress of the anchor is arranged between the anchor nut and an anchor plate (DE No. 10 05 474B1). One is meant to recognize whether the anchor is still tightened with the required prestress or has somewhat loosened from the degree of deformation of the spring when initially tightening the anchor nut. Apart from the fact that it is comparatively difficult and correspondingly expensive to fabricate spring elements with such a force characteristic, permitting an even somewhat reliable determination of the limiting force, the accuracy and the visual recognition of the indication or display are not very good.

It is also known, in a rock anchor with a rod-shaped tension member, to arrange a special washer, between the anchor nut and the anchor plate, which is equipped with fingers projecting obliquely and upwardly to different levels (U.S. Pat. No. 4,410,296). These fingers are dimensioned in such a way that they can only transmit a specific anchoring force, rupturing however consecutively when this force is exceeded. Audible signals are meant to arise when these fingers rupture, which acoustically indicate threatening overloads of the anchor. Apart from the fact that this special washer must also consist of a particular material and is difficult to fabricate, there exists the circumstance, if the purpose is to be achieved that an audible signal is to be generated at the rupture of the fingers, that an acoustical indication possibility is not sufficiently definite. An acoustical signal can only be sensed at the instant it occurs or only momentarily and only if a person is in direct vicinity of the anchoring device.

SUMMARY OF THE INVENTION

Accordingly, it is an object of the present invention to create the possibility in an anchoring device of the previously described type permitting an indication of having exceeded the anchoring force of a tension member with simple and economical means reliably, and so that the indication can be determined explicitly and perceived visually in a clear manner and is of some duration therefore not only instantaneously.

Pursuant to this object, and others which will become apparent hereafter, one aspect of the present invention resides in the support element encompassing a cylindrical hollow body surrounding the anchoring member, with the inner wall of the hollow body having projections at its lower region facing the anchor plate, which project inwardly beyond the inside contour of the inside wall. The anchoring element abuts the projections in such a way at least with partial regions of its cross-sectional area in a force-transmitting manner, that when a predetermined tensile force is exceeded the support element and/or the anchoring element is plastically deformable in the region of inter-engaging surfaces. Additionally, means are provided for indicating the thereby occurring relative displacement between the anchoring element and the support element.

The basic concept of the invention resides in utilizing only a partial surface of the anchoring element and the support element for force transmission between these two elements which are dimensioned and assigned to each other in such a way that at least one of these elements is worn off or razed when the tensile force is exceeded so that a relative displacement in axial direction results. The advantage in the invention consists, above all, in that this deformation occurs between parts which are anyway required for transmitting the force, so that additional parts which are expensive to fabricate are not required and can also not be forgotten and left out during installation. In addition, the deformation occurs between two parts which are separated from the tension member itself, thus the deformation is independent of the shape of the tension member and can therefore be used with any random tension member.

It is also advantageous if this deformation occurs in a closed cavity and is therefore independent of external influences, especially being protected against dirt and other contamination. The support element as well as the anchoring elements are comparatively simple parts to manufacture parts, whose geometric shape and tolerances can be handled satisfactorily, so that the accuracy and dependability of the indication is improved.

The difference in material hardness can be freely selected for both parts. Thus the support element, at least in the region of the projection, consists of a material which has a higher strength than the material of the anchoring element, which is plastically deformed when the tensile force is exceeded. On the other hand the anchoring element at least in the region entering into effective connection with the projection of the support element consists of a material having a higher strength than the material of the support element, which is plastically deformed when the tensile force is exceeded.

The magnitude of the maximum tensile force can be controlled within wide ranges and can also reach comparatively large values by appropriate shaping of the outer contour of the anchoring element as well as the periphery of the support element. If the partial surfaces of the support element or the anchoring element enter into inter-effective connection with each other in different planes extending transversely to the longitudinal axis of the anchoring device and are spaced from each other in the axial direction, a stagewise indication with more than one limit load can also be achieved. The individual partial surfaces then come into contact successively corresponding to the rise of the anchoring force and as a consequence of ground deformation.

The partial surfaces of the support element and the anchoring element entering into inter-effective connection with each other can also be arranged along a helical screw line and thus form a thread. Herein the support element can be designed as a nut and can be rotatable with respect to the anchoring plate.

The anchoring element can also be designed as a nut and can be threaded upon the tension member which is a steel rod. The anchoring element can, however, also be a sleeve pressed by cold deformation due to radial compression upon the tension member which is a steel wire strand.

A head plate is expediently provided for indication of the relative displacement, and is fixedly connectable with the tension member above the anchoring element and which comprises elements bridging the distance to the support element or the anchor plate, which elements or pins can abut against said anchor plate. If this distance is reduced as a consequence of the longitudinal displacement of the anchoring element, these elements or pins on the head plate are changeable in their visual appearance.

The head plate can be penetrated by at least one pin extending in the direction of the motion which exits from the top side of the head plate in case of a longitudinal displacement of the anchoring element with respect to the support element. However, several pins of differing lengths can also be provided.

Alternatively, the head plate can be part of a hood sealing the support elements. In this way an optical indication is achieved even if the entire anchoring device is encapsulated by a corrosion protective cover.

A particularly simple design of the indicator device results if a cylindrical sleeve is provided between the head plate and the support element or the anchor plate, which has a rated break point in compression somewhere along its length. The rated break point is expediently produced by weakening the wall of the sleeve on the inside.

Here also the sleeve can be connected to form one piece with the head plate and to form a covering hood sealing the support element or the anchor plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a longitudinal section through a rock anchor with an anchoring device pursuant to the present invention arranged at the downstream side;

FIGS. 2*a* and *b* show an embodiment of an anchoring device at an enlarged scale in a longitudinal section in two different loading conditions;

FIG. 3 is a cross-section through the support element of the anchoring device in FIG. 2;

FIG. 4 is a plan view of the anchoring element of the anchoring device in FIG. 2;

FIG. 5 is a diagram showing the course of the anchoring force;

FIG. 6 is another embodiment of the anchoring device in longitudinal section;

FIG. 7 is a cross-section along the line VII—VII in FIG. 6;

FIG. 8 is an additional embodiment of the anchoring device in longitudinal section;

FIG. 9 is a cross-section along the line IX—IX in FIG. 8; and

DETAILED DESCRIPTION OF THE PREFERRED EMBODIMENTS

Figure 10A:
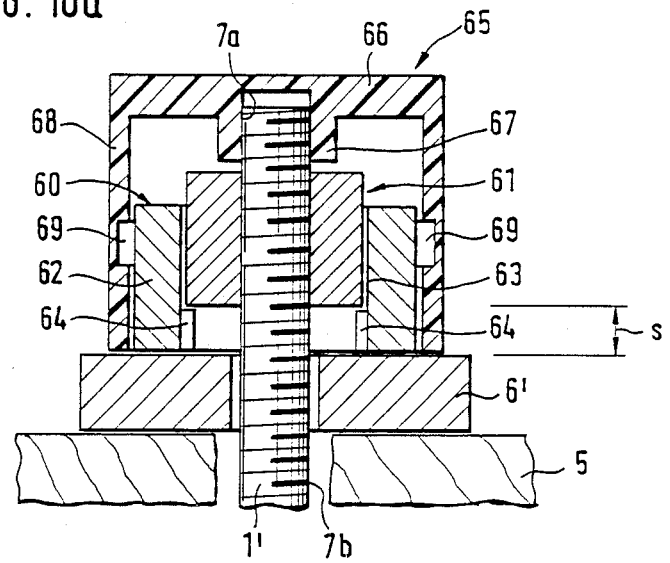
FIGS. 10*a* and *b* show still another embodiment of the anchoring device in longitudinal section in two different loading conditions.

FIG. 1 shows a longitudinal section through a rock anchor with a tension member 1, which is inserted into a borehole 2. The borehole 2 is filled along its entire length with hardening material 3, for instance synthetic resin adhesive, with the tension member 1 being embedded and anchored over a specific distance in the lower region of the borehole. The tension member 1 is freely extensible over the remaining portion of its overall length, for instance by being guided within a jacket tube 4. An anchoring device A is arranged at the downstream (or air) side for securing the excavation face 5. The anchoring device is supported by an anchor plate 6 against the excavation face 5.

A first embodiment of an anchoring device A is shown in elongated longitudinal- and cross-section and in FIGS. 2 to 4. According to FIG. 2*a* the anchoring device consists of a support element 10 and an anchoring element 11. This anchoring element 11 is designed as an anchor nut with a hexagonal cross-section (FIG. 4) which is threaded with its inside thread 7*a* upon the external thread 7*b* of a tension member provided as an anchor rod 1'. The support element 10 includes a hollow body 12 which in the depicted embodiment consists of a cylindrical jacket with a hexagonal horizontal projection corresponding to the anchor nut (FIG. 3).

The hollow body 12 is connected to form one piece with a base part 13 and have a central bore 14 for passage of the anchor rod 1'. The bottom side of the base part 13 is hemispherical, in order to be able to execute angular rotations to a certain extent with respect to the anchor plate 6.

Inside of the hollow body 12 in the region of a top surface 15 of the base part 13, there are located projections 17 which adjacently protrude over the inside wall 16 of the hollow body 12 and form a shoulder 18 at their upper end. It is discernible from FIG. 3, which shows a cross-section through the hollow body 12 without the anchor nut 11, that the shoulder 18 forms a circular inner edge, whose diameter D corresponds to the diameter of the circle tangential to the hexagonal cross-section of the hollow body 12. The shoulder 18 thus consists of individual partial faces 19 between the inscribed tangential circle and the inner face 16 of the hollow body 12.

The anchor nut 11 corresponds in its horizontal projectional shape to the inside cross-section of the hollow body 12, so that it is retained non-rotatably therein, however it is longitudinally displaceable. FIG. 2*a* shows the anchor nut 11 shortly before contact with the shoulder 18 of the support element 10. When the entire load is carried, the anchor nut 11 rests against the shoulder 18 of the support element 10 and thus transmits the anchoring force in the partial faces 19 (FIG. 4).

The anchor nut 11 is turned on a lathe to be circularly shaped at its bottom end, so that it finds guidance is in the lower narrower region of the inside space of the hollow body 12. The shoulder 18 itself is beveled at the surface, in order to make the application or engagement of the force more uniform. The strength of the material of the anchor nut 11 and the size of the partial faces 19 are chosen or tuned to each other in such a way that only an anchoring force up to a predetermined magnitude can be transmitted. When this force is exceeded the anchor nut 11 is plastically deformed in the region of the partial faces 19. Because of this deformation, a relative displacement between the support element 10 and the anchor nut 11 through a distance s is caused. FIG. 2*b* shows the condition after an accomplished displacement s'.

The magnitude of the displacement travel s, which permits judgment of a specific amount by which the anchoring force has been exceeded, can be indicated in a simple manner by adapting the length of the anchor nut 11 to the length of the hollow body 12 so that the anchor nut 11 completely disappears in the hollow body 12 when a specific anchoring force is reached. The surface 20 of the anchor nut 11 and the surface 21 of the hollow body 12 then lie in one and the same plane. This means a change of the shape of the anchoring device which can also be perceived in an explicit manner from a certain distance.

FIGS. 2*a* and *b* however also show another more comfortable possibility for indicating the displacement travel s which basically permits also the indication of several force stages. Here a head plate 22, for instance of plastic material, is placed for, instance threaded, upon the outer end of the anchor rod 1'. The head plate 22 is to be threaded on to a point where its bottom face 23 rests upon the top face 20 of the anchor nut 11. It then has the spacing s to the surface 21 of the hollow body 12. Spacer pins 24, 25 of different lengths are inserted in a clamped manner into the head plate 22, and penetrate through the head plate 22 upwardly and are visually perceivable from the outside if the spacing s is reduced because a deformation has occurred. In the condition in FIG. 2*a*, the longest pin 24 is not yet in contact with the surface 21 of the hollow body 12. In the condition in FIG. 2*b*, the pin 24 already protrudes upward, while the shorter pin 25 just contacts the surface 21. Any other indication devices can be utilized in place of these distance or spacer pins 24, 25. Another embodiment will be described below with the help of FIGS. 10*a* and *b*.

It can also be described with the help of the embodiment depicted in FIGS. 1 to 4 how an overload can be indicated gradually in stages. For this purpose the edges at the bottom side of the anchor nut 11 are razed to different levels. The anchor nut 11 then comes to rest with only several of these partial faces 19, mainly the lowermost ones, against the shoulder 18 of the support element 10. It is depicted in the diagram shown in FIG. 5 how a first longitudinal displacement through a travel $S_1$ occurs when the first stage of the tensile force $P_1$ is reached, until the next following partial faces of the anchor element 11 rest against the shoulder 18. Only when the second stage of the tensile force $P_2$ s reached does a displacement through the travel $S_2$ occur. Further stages can possibly follow upon this displacement. These different load stages can be indicated by the different length pins 24, 25 which emerge successively from the head plate 22. The highest load stage is attained when all pins have emerged.

A second embodiment of an anchoring device in the invention is depicted in FIGS. 6 and 7. This embodiment can be used for instance if angular rotations of the anchor rod with respect to the anchor plate are not anticipated. The hollow body 32 of the support element 30 is in this case placed directly, meaning without a base part, upon a simple flat anchor plate 6'. The anchor plate 6' abuts on its part directly against the excavation face 5.

In this embodiment, the hollow body 32 is also provided with projections 34 in its lower region protruding inwardly beyond its inner wall 33, which projections can, but are not required to, have an oblique surface. As is shown in FIG. 7, a total of four such projections 34 are distributed across the inner periphery of the hollow body 32.

The anchoring element 31 consists of a simple circularly cylindrical member, which is insertable into and guided by the circularly cylindrical cavity of the hollow body 32. In order to be able to thread the anchoring element 31 which is again provided with an inside thread 7*a* upon the external thread 7*b* of the anchor rod 1', the anchoring element can be provided with a hexagon 35 at its upper end. In this embodiment of the anchoring device, the projections 34 are worn off or razed when the tensile force is exceeded. The displacement travel arising therefrom is indicated on the outside to be visually recognizable in that the anchor nut 31 disappears inside of the hollow body 32.

A third embodiment of the anchoring device is depicted in FIGS. 8 and 9. In this embodiment, the tension member of the anchor is a strand 1'' of steel wires, upon which a sleeve by way of an anchoring element 41 is undisplaceably pressed by radial clamping pressure. Since this pressed-on sleeve 41 as a rule must consist of a comparatively soft material in order to be able to deform, an anchor ring 44 is arranged upstream of it in the force direction, which can be placed loosely upon the strand 1''. The anchor ring 45 is provided with projections 45 extending in a helical screw manner at its outer circumference. The hollow body 42 of the support element 40 comprises here at its inner side 43 an internal thread 46 matching the projections 45. The hollow body 42 consists expediently of a softer material than the anchor ring 44. The hollow body 42 in this case abuts again upon the base part 47, which in turn rests with its hemispherically-shaped bottom surface against the anchor plate 6 thus enabling angular rotations.

With this embodiment of the anchoring element 41, especially of the anchoring 44 and hollow body 42, one also achieves to a certain extent a prestraining and bracing of the strand 1'', since the hollow body 42 can be turned with respect to the bottom part 47 in a manner similar to a nut. In case of an overload, deformation occurs here in the threaded region between the anchor ring 44 and the hollow body 42.

The indication of the longitudinal displacement occurring herein is performed herein again by means of a head plate 48 which can be placed upon the strand 1'' or the anchoring element 41 from above. The head plate is here designed to form a cover hood 50 by molding a cylindrical wall 49 upon it, which hood reaches up to the region of the hollow body 42 and thus terminates the anchoring device so as to be protected from corrosion, to the extent that it includes the part for indicating the relative displacement. The pin 51 passes through the head plate 48, which abuts against the upper end face 52 of the hollow body 42, and exits upward from the head plate in case of a longitudinal displacement of this head plate connected with the strand 1''.

Figure 10B:
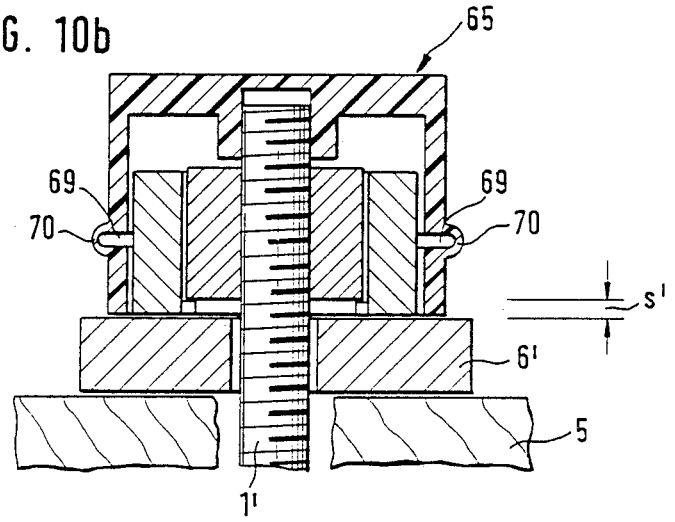

A last embodiment for an anchoring device pursuant to the invention, proceeding from the illustration in FIGS. 6 and 7, is depicted in FIGS. 10*a* and 10*b*. While the anchoring device as such corresponds in its essential characteristic, namely the support element 60 designed as a hollow body 62 and the anchoring element 61 designed as a nut, to that in FIGS. 6 and 7, a particularly simple and economical embodiment of the indication device for the displacement travel s is shown here. A cover hood 65 is placed upon the upper end of the anchor rod 1' equipped with an external thread 7*b*. The cover hood 65 consists of a head plate 66 which includes an extension 67 with an internal thread 7*a* at the inner side, which fits upon the external thread 7*b* of the anchor rod 1'. This cover hood 65 itself is formed by molding a cylindrical wall 68 at the external circumference of the head plate 66. The hood 65 can be screwed so far upon the anchor rod 1' until its lower end comes to sit upon the surface of the anchor plate 6'. Thus a closed-off cavity inside of the cover hood 65 is formed, which cavity can also be filled with corrosion protection material.

The cylindrical wall 68 of cover hood 65 is provided in the course of its length at the inside with a circumferential annular groove 69, forming a rated break point in compression. If, when the anchoring force is exceeded, the projections 64 protruding beyond the inner face 63 of the hollow body 62 are worn off by the anchoring element 61, if such a longitudinal displacement occurs, then the cylindrical wall 68 of the cover hood 65 is stressed in compression. This compressive stress results in rupture at the weakest point, in the region of the annular groove 69, which then deforms outwardly into a bead 70 (FIG. 10*b*. ). In this way the encapsulation of the anchoring device for protection against corrosion can be combined in a particularly simple and economical manner with an indication of having exceeded the anchoring force which is clearly recognizable visually on the outside.

While the invention has been illustrated and described as embodied in an anchoring device for a rod-shaped tension member of an anchor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An anchoring device for a tension member, comprising: an anchoring element undisplaceably connected with the tension member; an anchoring plate supported against an abutment; a support element arranged between the anchoring element and the anchor plate so as to transmit tensile force, the anchoring element and the support element being arranged so as to be displaceable relative to one another in a tensile force direction to indicate when a predetermined tensile force is exceeded, the support element including a cylindrical hollow body provided so as to surround the anchoring element, the hollow body having an inner wall with a lower region facing the anchoring plate, projections are provided on the lower region of the inner wall so as to project inwardly beyond an inside contour of the inner wall so that the anchoring element abuts with partial regions of its cross-sectional surface against the projections in a force-transmitting manner, at least one of the support element and the anchoring element being plastically deformable in a region of their interengaging surfaces when a predetermined tensile force is exceeded; and means for indicating displacement between the anchoring element and the support element.

2. An anchoring device according to claim 1, wherein the support element at least in a region of the projections consists of a material having a higher strength than the material of the anchoring element, which is plastically deformable if the tensile force is exceeded.

3. An anchoring device as defined in claim 1, wherein the anchoring element consists of a material at least in a region coming into effective interaction with the projections of the support element which has a higher strength than the material of the support element which is plastically deformable if the tensile force is exceeded.

4. An anchoring device as defined in claim 1, wherein the partial faces of one of the support element and the anchoring element each coming into effective interaction with each other lie in different planes arranged to be spaced in an axial direction from each other and extend transversely to the longitudinal axis of the anchoring device.

5. An anchoring device as defined in claim 1, wherein the projections of the support element and the anchoring element which come into effective connection with each other are arranged along a helical screw line and form a thread.

6. An anchoring device as defined in claim 5, wherein the support element is a nut which is rotatable with respect to the anchoring plate.

7. An anchoring device as defined in claim 1, wherein the tension member is a steel rod, the anchoring element being a nut that is threadable upon the tension member.

8. An anchoring device as defined in claim 1, wherein the tension member is a steel wire strand, the anchoring element being a sleeve pressed by radial compression and cold deformation upon the tension member.

9. An anchoring device as defined in claim 1, and further comprising a head plate provided so as to indicate the relative displacement, the head plate being rigidly connectable with the tension member above the anchoring element and which includes elements which bridge over a distance to one of the support element and the anchor plate and are abuttable thereagainst, the elements having a visual appearance which is changeable if this distance is reduced by longitudinal displacement of the anchoring element.

10. An anchoring device as defined in claim 9, and further comprising at least one pin aranged so as to penetrate the head plate and extend in a direction of movement, so that in case of a longitudinal displacement of the anchoring element with respect to the support element, the at least one pin can exit from a top side of the head plate.

11. An anchoring device as defined in claim 10, wherein several pins of differing lengths are provided.

12. An anchoring device as defined in claim 10, wherein the head plate is a portion of a hood which is sealed against one of the support element and the anchor plate.

13. An anchoring device as defined in claim 9, and further comprising a cylindrical wall provided between the head plate and one of the support element and the anchor plate, said cylindrical wall having a rated compression break point in the course of its length.

14. An anchoring device as defined in claim 13, wherein the rated break point is formed by an annular groove fabricated from an inner side of the cylindrical wall.

15. An anchoring device as defined in claim 13, wherein the cylindrical wall is connected with the head plate so as to form one piece and constitute a cover hood sealed against one of the support element and the anchor plate.

* * * * *